US005469909A

United States Patent [19]

Sasaki et al.

[11] Patent Number: 5,469,909

[45] Date of Patent: Nov. 28, 1995

[54] COOLING DRUM FOR A CONTINUOUS CASTING SYSTEM AND METHOD FOR MANUFACTURING THE SAME

[75] Inventors: Kunimasa Sasaki; Youichi Wakiyama; Takahiro Matsumoto; Kisaburo Tanaka; Keiichi Yamamoto, all of Hiroshima, Japan

[73] Assignee: Mitsubishi Jukogyo Kabushiki Kaisha, Tokyo, Japan

[21] Appl. No.: 257,746

[22] Filed: Jun. 9, 1994

[30] Foreign Application Priority Data

Dec. 22, 1992 [JP] Japan ..... 4-342410

[51] Int. Cl.[6] ..... B22D 11/06

[52] U.S. Cl. ..... 164/428; 164/448

[58] Field of Search ..... 164/428, 480, 164/429, 448, 423

[56] References Cited

U.S. PATENT DOCUMENTS 5,152,333 10/1992 Barbe et al. ..... 164/429

FOREIGN PATENT DOCUMENTS

| | | | |
|---|---|---|---|
| 0024506 | 3/1981 | European Pat. Off. . | |
| 0428464 | 5/1991 | European Pat. Off. . | |
| 2666756 | 3/1992 | France . | |
| 2421801 | 11/1975 | Germany | 164/429 |
| 3839110 | 6/1989 | Germany . | |
| 62-275588 | 11/1987 | Japan . | |
| 63-6308 | 2/1988 | Japan . | |
| 63-192544 | 8/1988 | Japan | 164/428 |
| 3-169461 | 7/1991 | Japan . | |
| 92/11959 | 7/1992 | WIPO . | |

OTHER PUBLICATIONS

Patent Abstracts of Japan, vol. 14, No. 416 (M-1021) (4359) Sep. 7, 1990.

Patent Abstracts of Japan, vol. 13, No. 432 (M-874) (3780) Sep. 27, 1989.

Patent Abstracts of Japan, vol. 6, No. 130 (M-143) (1008) Jul. 16, 1982.

*Primary Examiner*—Kuang Y. Lin

*Attorney, Agent, or Firm*—Wenderoth, Lind & Ponack

[57] ABSTRACT

A cooling drum which can continuously cast a favorable band-shaped cast piece having little thermal deformation and a method for manufacturing the same cooling drum, are disclosed. The cooling drum comprises a three-layer structure consisting of a rigid member, a cooling member metallurgically bonded to the outside of the rigid member, and a heat-resistance member plated by electro-deposition on the outer circumferential surface of the cooling member. The rigid member is made of austenite group stainless steel, the cooling member is made of Cu or Cu-alloy, and the heat-resistance member is made of either Ni or its alloy or Co or its alloy. Within the rigid member are equipped partition walls and tubular partition walls. To the opposite end portions of the rigid member are connected hollow shafts adapted to be rotationally driven, by means of bolts after shrinkage fitting. In the cooling member are drilled cooling holes for communicating a coolant as distributed over the entire circumference, extending in the axial direction of the drum. The cooling holes are communicated with a flow passageway of a coolant formed by the partition walls and the tubular partition walls through cooling passageways.

4 Claims, 4 Drawing Sheets

COOLING DRUM FOR A CONTINUOUS CASTING SYSTEM AND METHOD FOR MANUFACTURING THE SAME

BACKGROUND OF THE INVENTION:

1. Field of the Invention

The present invention relates to a cooling drum for a twin-drum type continuous casting system or a single-drum type continuous casting system, and also relates to a method for manufacturing such cooling drum.

2. Description of the Prior Art

Heretofore, in a system for continuously casting a band-shaped cast piece with a single drum or twin drums, various structures of a cooling drum which take prevention of thermal deformation into consideration have been proposed. As one example of such cooling drums, a structure shown in FIG. 6 was disclosed in Laid-Open Japanese Patent Specification No. 3-169461 entitled "Rolls for a system for continuously casting with a single roll or between twin rolls". In this roll, a central portion of a sleeve 7 coming into contact with molten metal is mechanically restrained with respect to a core 6 by means of a side plate 4 and an annular clamp member 3, and the core 6 is fixedly secured to a shaft 2 via a hub 1. The sleeve 7 is cooled by making coolant flow through the inside of the sleeve 7 and the core 6 as shown by arrows in FIG. 6.

In the above-described roll, since the sleeve 7 is mechanically restrained by the core 6, thermal deformation at a position remote from the restrained portion is large, and the magnitude of the thermal deformation increases as a casting time elapses. More particularly, as a thermal strain of the sleeve 7 arises in excess of a yielding strain, a fastening strain between the sleeve 7 and the core 6 is lowered. In addition, due to thermal elongation of the sleeve 7, wear and abrasion of fitting surfaces of the sleeve 7 and the core 6 are caused by slipping therebetween, hence a fastening force is gradually relaxed, and eventually a gap clearance is produced between them.

Consequently, there was a shortcoming that the magnitude of thermal deformation of the cooling roll which determines a cast piece configuration would become large as a casting time elapses. A working time of a cooling drum was several minuts in the case where the sleeve 7 is made of material having a low thermal conductivity such as, for example, steel, and even in the case of employing material having a high thermal conductivity such as copper alloys, it was several hours at maximum. There was a shortcoming that at a time close to this limit time, thermal deformation exceeded 1000 μm and a distribution of a crown of a cast piece also exceeded ±50 μm.

SUMMARY OF THE INVENTION

It is therefore one object of the present invention to provide an improved cooling drum for a continuous casting system, which is free from the above-described shortcomings in the prior art and whose thermal deformation can be fully prevented, whereby a high-quality band-shaped cast piece having a small difference in thickness between its central portion and opposite end portions can be continuously cast.

Another object of the present invention is to provide the above-described type of cooling drum, in which heat transmission from molten metal to the cooling drum is suppressed, heat transmitted to the cooling drum is quickly removed, a corrosion-resistance as well as a rigidity of the drum are enhanced to prevent its deformation, and its life is elongated.

Still another object of the present invention is to provide a cooling drum having a high rigidity and such construction that coolant for removing heat transmitted from molten metal can smoothly communicate through the drum.

A still further object of the present invention is to provide a cooling drum having a coolant communication structure which can quickly remove heat transmitted from molten metal and also can avoid temperature distribution in the drum from becoming uneven.

Yet another object of the present invention is to provide a method for manufacturing a cooling drum for a continuous casting system, which is composed of different kinds of metals bonded via a highly reliable metallurgical bonding surface, has a high rigidity, is hardly deformed and has a long life.

According to one feature of the present invention, in order to achieve the above-mentioned objects, a cooling drum for a continuous casting system employs a construction having a three-layer structure consisting of a cylindrical rigid member, a cylindrical cooling member fitted around an outer circumferential surface of the same rigid member and having its inner circumferential surface metallurgically bonded to the above-mentioned outer circumferential surface, and a heat-resistance member formed by electro-deposition plating on an outer circumferential surface of the same cooling member, and provided with cooling holes drilled in the above-mentioned cooling member as distributed over its entire circumference and extending in the axial direction of the above-mentioned cooling drum, and coolant passageways connecting the opposite axial end portions of these cooling holes with an inner circumferential portion of the above-mentioned rigid member.

According to the present invention, when the cooling drum employing the construction having a three-layer structure consisting of a rigid member, a cooling member metallurgically bonded to the outside of the rigid member and a heat-resistance member formed by electro-plating on the outer circumferential surface of the cooling member and also having cooling holes for communicating coolant in the cooling member as described above, is used, while the cooling drum is rotated, molten metal being fed continuously is cooled and solidified by the cooling drum in the following manner, and thereby a highly qualified band-shaped cast piece can be continuously cast. That is, the heat-resistance member of the cooling drum suppresses transmission of sensible heat and latent heat (heat of solidification) of molten metal to the cooling member, the cooling member transmits the transmitted heat to coolant flowing through the cooling holes in the cooling member and reduces its temperature rise, and further, thermal deformation caused by uneven temperature distribution slightly remaining in the cooling member is restrained by the rigid member and is made small.

According to another feature of the present invention, in order to achieve the above-mentioned objects, in the above-featured cooling drum, the above-described rigid member is made of austenite group stainless steel, the above-mentioned cooling member is made of either Cu or Cu-alloy, and the above-described heat-resistance member is made of either a mono-layer plated metal as of Ni, Ni-alloy, Co or Co-alloy or a multi-layer plated metal as of Ni-polynite-Cr.

The cooling drum according to the present invention, in which the rigid member is made of austenite group stainless steel, the cooling member is made of Cu or Cu-alloy and the heat-resistance member is made of metal such as Ni-polynite-Cr, Ni or Co, has, in addition to the above-described advantages, the advantages that the rigid member prolongs its life owing to a high corrosion-resistance of austenite group stainless steel, enhances its rigidity during use thanks to a high Young's modulus and thereby increases a restraining force acting upon the cooling member. Also, it has the advantage that owing to the cooling member made of Cu or Cu-alloy, a heat transmission property of the cooling roll is enhanced, heat transmitted from the heat-resistance member along the surface of the roll is quickly transmitted to coolant to cool the roll, and thereby thermal deformation of the roll is reduced. In addition, it has the advantage that owing to the thin-walled heat-resistance member made of metal such as Ni-polynite-Cr, Ni or Co which has a relatively low thermal conductivity, heat dissipation at a high temperature upon continuous casting is reduced, and transmission of sensible heat and heat of solidification of molten metal to the cooling member is further decreased.

According to still another feature of the present invention, in order to achieve the above-mentioned objects, in the above-featured cooling drum, the above-described rigid member is shaped in such manner that a ratio of its inner diameter to its outer diameter may take a value of 0.4–0.6, and an interval in the circumferential direction of the drum between the centers of the adjacent cooling holes in the above-described cooling member is chosen equal to or smaller than twice the distance between the center of the same cooling hole and the outer circumferential surface of the above-mentioned cooling member.

According to the present invention, owing to employment of the cooling drum having a rigid member which has a ratio of an inner diameter to an outer diameter chosen to be 0.4–0.6, in addition to the above-described advantages, there is provided an advantage that as a result of the fact that a wall thickness of the cylindrical rigid member becomes large to such extent that coolant can smoothly communicate through the inside of the rigid member, a rigidity of that member is further enhanced, hence a restraining force acting upon the cooling member in which an uneven temperature distribution remains slightly is enlarged to further reduce its thermal deformation, and therefore, a highly qualified band-shaped cast piece can be produced.

In addition, according to the present invention, owing to employment of the cooling drum in which an interval in the circumferential direction of the drum between the centers of the adjacent cooling holes is chosen to be equal to or smaller than twice the distance between the center of the cooling hole and the outer circumferential surface of the cooling member, in addition to the above-described advantages, there is provided an advantage that since the intervals in the circumferential direction of the drum between the respective cooling holes in the cooling member are made small, cooling of the cooling member by the coolant flowing through the cooling holes in the cooling member is promoted, hence an uneven temperature distribution in the cooling member is further decreased, and therefore, a highly qualified band-shaped cast piece can be continuously produced.

Furthermore, according to yet another feature of the present invention, in order achieve the above-mentioned object relating to a method for manufacturing the above-featured cooling drum, there is provided a method for manufacturing a cooling drum, in which a restraining member is fitted around an outer circumferential surface of a cooling member in which a cylindrical rigid member has been fitted with a mold releasing agent interposed between the bonding surfaces of the both members, the bonding surfaces of the above-mentioned rigid member and the above-mentioned cooling member are raised in temperature and held at a temperature of 900° C. or higher while maintaining in an evacuated state, the temperature of the above-mentioned rigid member is made higher than the above-mentioned restraining member by further heating it from the side of its inner circumference, and after the above-described rigid member and the above-described restraining member have been metallurgically bonded by pressing the aforementioned bonding surfaces as a result of difference in thermal expansion between there members, a heat-resistance member is plated through electro-deposition on the surface of the cooling member.

In the method for manufacturing a cooling drum by metallurgically bonding a rigid member to a cooling member according to the present invention, since the rigid member, the cooling member and a restraining member are heated to raise the temperature of the bonding surface between the rigid member and the cooling member up to 900° C. or higher under an evacuated state, and the rigid member is further heated from the side of its inner circumference to raise the temperature of the rigid member higher than the restraining member, the rigid body expands larger than the restraining member, hence the above-mentioned bonding surface is subjected to a surface pressure necessary for metallurgical bonding because the cooling member is restrained by the restraining member, and therefore, the outer circumferential surface of the rigid member and the inner circumferential surface of the cooling member are metallurgically firmly bonded.

When the above-described bonding has been completed and the members have been cooled to a normal temperature, since a mold releasing agent is interposed between the cooling member and the restraining member, these members would not be metallurgically bonded, and the bonded cooling member and rigid member can be easily extracted from the restraining member.

It is to be noted that a heat-resistance member is formed by electro-deposition plating on the outer surface of the cooling member after the above-described metallurgical bonding and machining for shaping.

The above-described and other objects, features and advantages of the present invention will become more apparent by reference to the following description of preferred embodiments of the invention taken in conjunction with the accompanying drawings.

DESCRIPTION OF THE PREFERRED EMBODIMENTS:

In the following, preferred embodiments of a cooling drum for a continuous casting system according to the present invention as well as a preferred mode of practicing a method for manufacturing a cooling drum according to the present invention, will be described in detail with reference to FIGS. 1 to 4 in the accompanying drawings.

Figure 1:
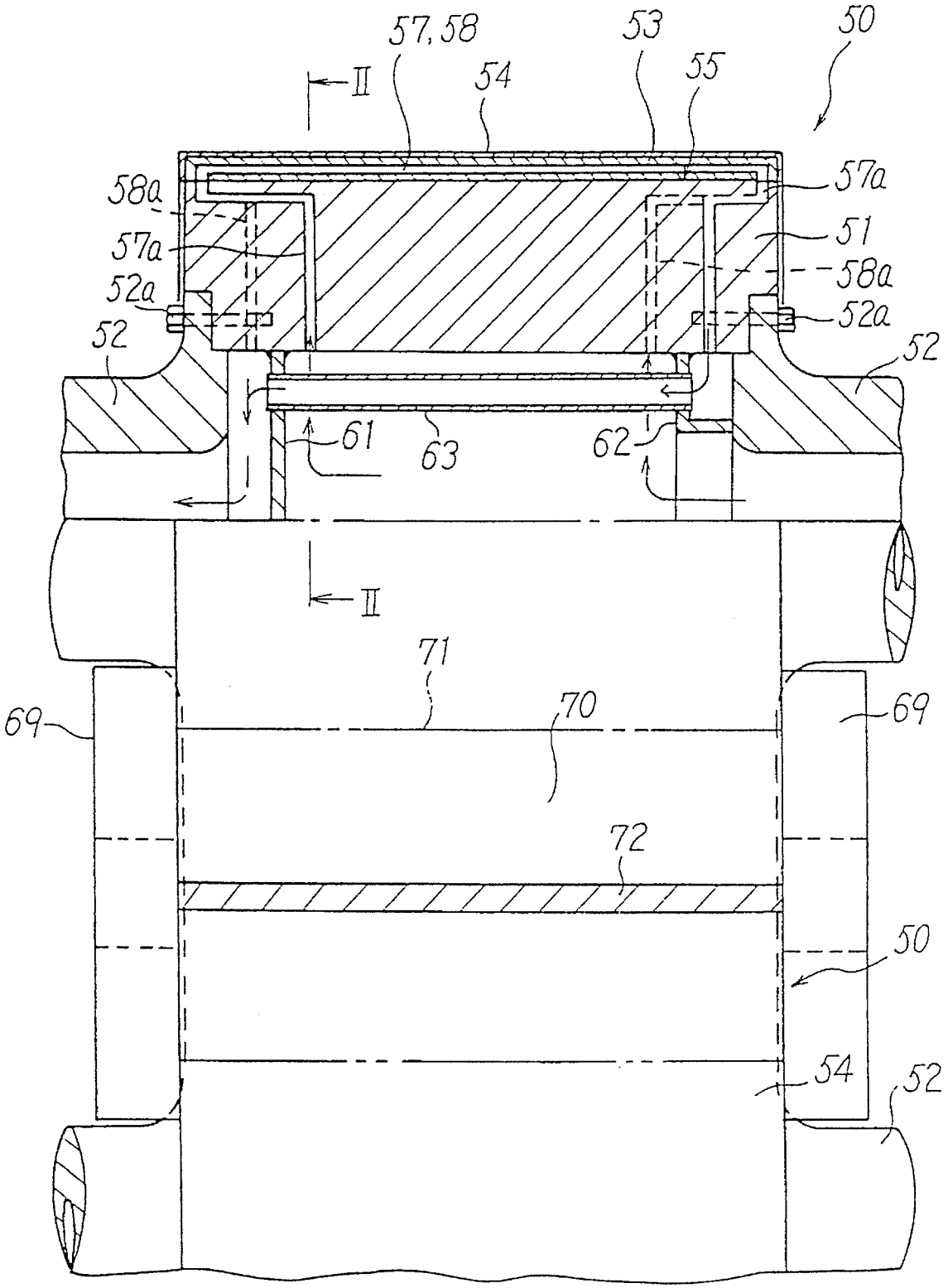
FIG. 1 is a plan view partly cut away of a twin-drum type continuous casting system employing a cooling drum according to one preferred embodiment of the present invention.
Figure 2:
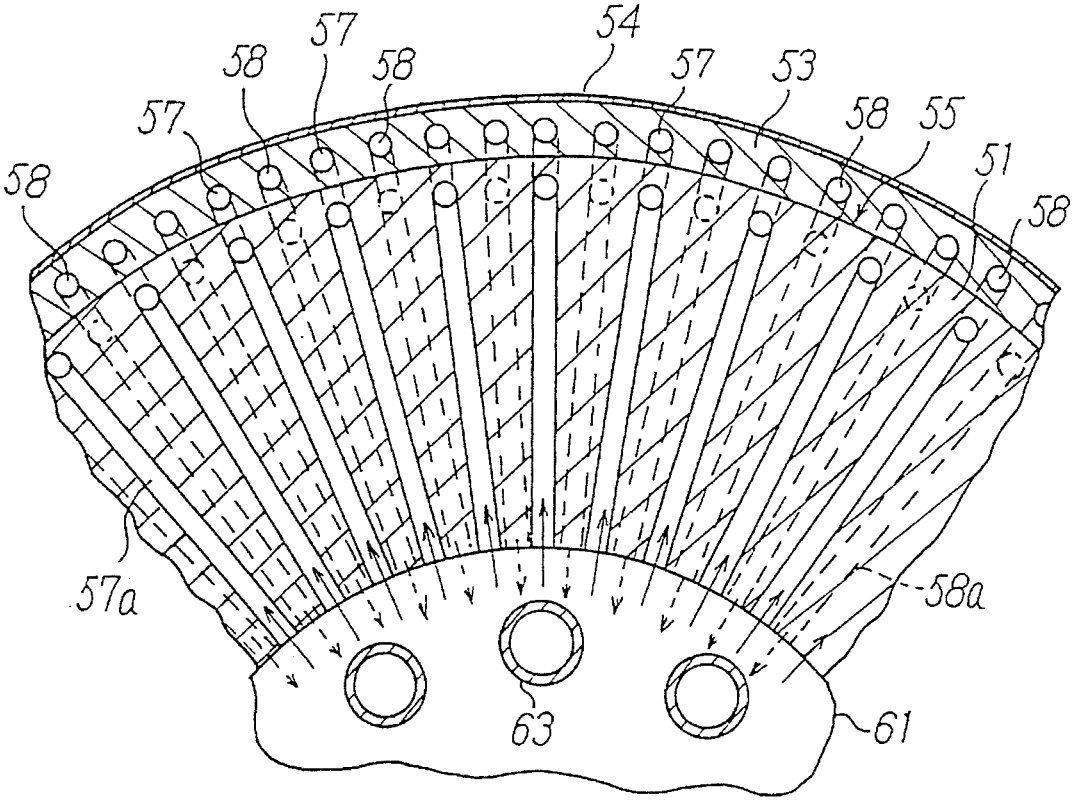
FIG. 2 is an enlarged cross-section side view taken along line II—II in FIG. 1.
Figure 3:
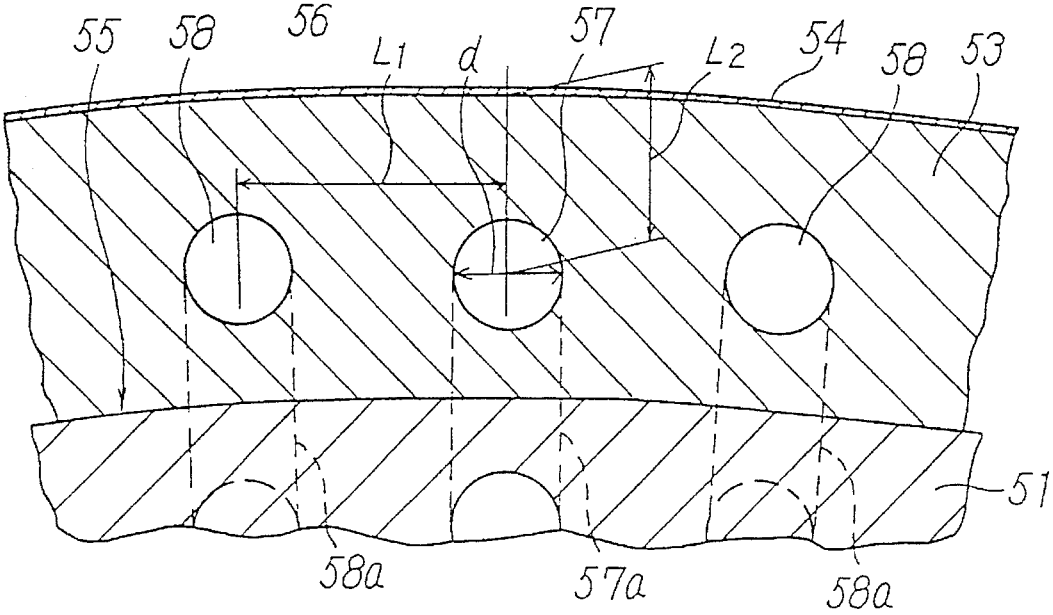
FIG. 3 is a partial cross-section view showing in further enlarged scale an essential part of FIG. 2.

In FIGS. 1 to 3, a rigid member 51 is made of SUS304 austenite group stainless steel and is formed in a cylindrical shape having an inner diameter of 272 mm, an outer diameter of 512 mm, a thickness of 120 mm and a length of 600 mm, whose ratio of (inner diameter)/(outer diameter) is about 0.53.

Onto the outer circumferential surface of this rigid member 51 is metallurgically bonded, through diffusion bonding, a cooling member 53 having a thickness of 42 mm, made of Cu-alloy containing 0.6% Cr and 0.15% Zr and having a thermal conductivity corresponding to IACS 50–80% at a temperature of 150° C. or lower.

Inside the rigid member 51 are mounted partition walls 61, 62 and a tubular partition wall 63, and to the opposite end portions of the rigid member 51 are shrinkage-fitted hollow shafts 52 to be rotationally driven, and thereafter, they are fastened by many bolts 52*a* distributed along their circumferential direction.

Figure 4:
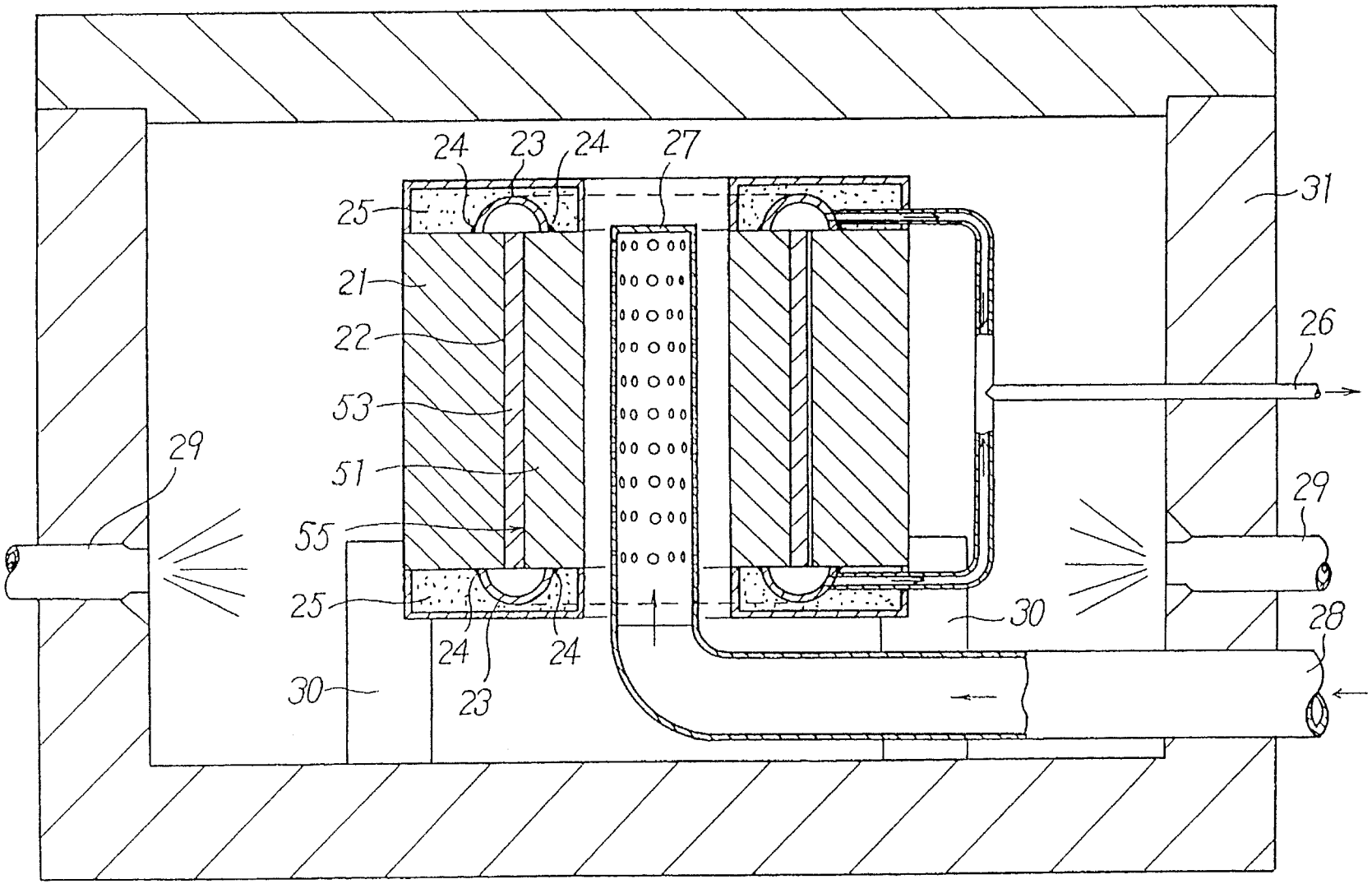
FIG. 4 is a vertical cross-section view showing a mode of metallurgically bonding a rigid member and a cooling member in a method for manufacturing a cooling drum according to the present invention.

The metallurgical bonding portion between the rigid member 51 and the cooling member 53 is diffusion-bonded by means of an apparatus and jigs shown in FIG. 4.

As shown in FIG. 4, the cooling member 53 is fitted around the rigid member 51 as by elongation or shrinkage fitting so that the gap clearance therebetween may become as small as possible, a mold releasing agent is applied to the outer circumferential surface of this cooling member 53, then a restraining member 21 having a lower coefficient of thermal expansion than the rigid member 51 such as, for example, a member made of cast iron is fitted around the cooling member 53 as by elongation or shrinkage fitting so that the gap clearance therebetween may become as small as possible, thereafter a ring-shaped vacuum seal caps 23 are fixedly secured to the fitted portions by seal welding 24, an evacuating pipe 26 is connected to these vacuum seal caps 23, and further the assembly is covered by heat-insulating materials 25.

The assembly consisting of the above-described members is carried in a heating furnace 31 and is supported by support tables 30 with a perforated muffle 27 inserted within the inner circumference of the rigid member 51, and thereby a retort is formed so that a bonding boundary surface 55 between the rigid member 51 and the cooling member 53 may become a nearly vacuum state as a result of evacuation through the evacuating pipe 26.

Then, the atmosphere in the heating furnace 31 is raised in temperature by means of a number of burners 29, furthermore combustion gas is introduced through a duct 28 and is made to spout from the perforated muffle 27 to the inner circumferential surface of the rigid member 51, and thereby the rigid member 51 is raised in temperature about 50°–100° C. higher than the restraining member 21.

In this way, the bonding boundary surface 55 is raised in temperature up to 900°–950° C., simultaneously the rigid member 51 is made to expand larger than the restraining member 21 due to the differences in a coefficient of thermal expansion and a temperature between the rigid member 51 and the restraining member 21, thus a surface pressure necessary for diffusion bonding is generated on the bonding boundary surface 55, and this state is maintained for a predetermined period of time to metallurgically bond the members 51 and 53.

Thereafter, where the assembly has been cooled to the neighborhood of a normal temperature, it is carried out from the heating furnace 31, the heat-insulating material 25, the vacuum seal caps 23 and the evacuating pipe 26 are removed, and the restraining member 21 is extracted from the cooling member 53.

It is to be noted that for the bonding between the rigid member 51 and the cooling member 53, a hot hydrostatic pressing method could be employed.

After the diffusion-bonded rigid member 51 and cooling member 53 have been machined for shaping, a heat-resistance member 54 made of Ni of 2 mm in thickness is plated by electro-deposition on the cooling member 53. The material and thickness of the heat-resistance member 54 were determined according to the following condition.

With regard to the material, as a material which is relatively easily oxidized, has a small reactivity with molten metal 71 and a relatively high melting point, is hardly subjected to change of properties caused by temperature rise at the time of continuous casting, and has a large bonding force with the cooling member 53 made of Cu-alloy, Ni, Ni-alloy, Co, Co-alloy and Ni-polynite-Cr were acceptable, and those having a thermal conductivity at 300° C. of 0.10–0.18 cal/cm.K were favorable.

With regard to the thickness of the heat-resistance member 54, a value δ (cm) given by the following Equation-(1) was favorable:

$$\delta\,(\text{cm}) \leqq \sqrt{K \cdot \tau''} \qquad \text{Equation-(1)}$$

where $$\tau'' = \frac{\theta D}{2v}$$

τ"=contact time between molten metal and cast piece (sec)

K=diffusivity of heat ($cm^2$/sec)

θ=contact angle between molten metal and cast piece (rad)

D=outer diameter of drum (cm)

v=optimum casting velocity (cm/sec).

Although there is no problem with regard to the lower limit of the thickness, in view of a machining precision, it was necessary to choose a thickness of 0.3 mm or larger.

In the cooling member 53 are drilled 44 in total of cooling holes 57 and 58 having a diameter $\bar{d}$=16 mm along the axial direction of the drum as distributed over the entire circumference along the circumferential direction at the positions of $L_2$=25 mm and $L_1/L_2$=1.56, where symbol $L_1$ represents a distance between the centers of the adjacent cooling holes and symbol $L_2$ represents a distance between the center of the cooling hole and the surface of the cooling member 53 as seen in FIG. 3.

Here, the positions of the cooling holes 57 and 58 are determined in the following manner. That is, a minimum distance Δ between the outer circumferential surface and the circumference of the cooling hole 57 or 58, which is equal to ($L_2$–d/2), is determined on the basis of a penetration depth of heat as represented by the following Equation-(2):

$$\Delta\,(\text{cm}) = (L_2 - 1/2\,d) \leqq 2.0\sqrt{K \cdot \tau'} \qquad \text{Equation-(2)}$$

where d=diameter of cooling hole (cm)

$$\tau' = \frac{(2\pi - \theta) \cdot D}{2v}$$

τ'=non-contact time between molten metal and cast piece (cooling time of cooling member).

The value of the minimum distance Δ is different depending upon material of the cooling member 53, in the case of Cr-Zr copper, a value of maximum 2.5 cm is favorable, and at a value larger than this value, temperature rise of the cooling member 53 is brought about, simultaneously temperature rise of the heat-resistance member 54 on the surface is generated, resulting in inconvenience of the system.

Also, an interval ($L_1$–d) in the circumferential direction between the adjacent cooling holes 57 and 58 is determined by the following Equation-(3):

$$(L_1 - d) \leqq 2.5\,(L_2 - 1/2\,d) \qquad \text{Equation-(3)}$$

$$\Delta\,(\text{cm}) = (L_2 - 1/2\,d) \leqq 2.0\sqrt{K \cdot \tau'}$$

where $$\tau' = \frac{(2\pi - \theta)}{2v}$$

$L_1$=center distance between adjacent cooling holes (cm).

If the value of the interval ($L_1$–d) becomes larger, then a temperature difference between the cooling hole portions 57 and 58 of the cooling member 54 and the interval portion therebetween at the time of continuous casting becomes large, and defects such as cracks or the like are produced in a cast piece 72.

On the other hand, if the value of the interval ($L_1$–d) becomes smaller, then sometimes due to a pressing force of the cooling drum, buckling is generated in the interval portion between the cooling holes 57 and 58. However, in a single-drum type system, since there is no such fear, especially no limitation is imposed thereon.

By the way, a rigidity of a cylindrical body is determined by its outer diameter and wall thickness. As a result of tests for the rigid member 51, it was proved that when a ratio $D_{Ri}/D_R$ is 0.4–0.65, the rigidity is favorable, where $D_R$: outer diameter of rigid member, $D_{Ri}$: inner diameter of rigid member.

In the case where $D_{Ri}/D_R$ is less than 0.4, though a resistance against insurance of a drum torque as well as insurance of a coolant water passageway are difficult.

If $D_{Ri}/D_R$ exceeds 0.65, then a thermal deformation exceeds 600 μm and also distribution of the thermal deformation during continuous casting exceeds ±50 μm, and therefore, it was disadvantageous to use the cast piece 71 as a raw material for cold rolling.

A pair of cooling drums 50 each having an outer diameter of 600 mm and a width of 604 mm are constructed from the above-mentioned members disposed at the abovementioned locations. Reference numeral 69 designates a pair of side weirs, which are disposed so as to slide along the opposite side surfaces of the rotating cooling drums 50.

Now, description will be made on preferred embodiments of the above-described continuous casting system.

FIRST PREFERRED EMBODIMENT

As shown in FIG. 1, coolant water is made to flow from coolant water passageways 57*a* and 58*a*, respectively, through the respective cooling holes 57 and 58 in the opposite directions to each other at a flow rate of 3000 liters/min. to cool the cooling member 53 symmetrically with respect to a midplane perpendicular to the axial direction of the cooling drum 50, and while the rigid member 51 is being cooled also by the coolant water, the both cooling drums 50 are rotated, molten metal 71 of austenite group stainless steel is fed to a basin 70 formed by the both side weirs 69 to be solidified, and thereby a band-shaped cast piece 72 is continuously cast.

During this continuous casting, the cooling drums 50 absorb the sensible heat and the solidification heat of the molten metal 71 and thermally deforms into a barrel shape, and hence the cast piece is formed in an inverse-crown shape whose central portion is thinner than the opposite edge portions.

However, in the case of the cooling drums 50 according to the above-described embodiment, since the above-described heat absorption by the cooling member 53 is suppressed by means of the heat-resistance member 54 and the cooling member 53 is cooled by the coolant water flowing through the cooling holes 57 and 58 to minimize its temperature rise, and further since the rigid member 51 is made thick to enhance its rigidity and the cooling member 53 was metallurgically bonded onto the entire surface of the rigid member having a high rigidity, as a result of tests, it was proved that the barrel-shaped thermal deformation can be suppressed to 160 μm in terms of a difference in radius as cast piece data and distribution of the deformation according to lapse of a casting time also can be suppressed to as small as ±12 μm in terms of a standard deviation.

In addition, since the above-described thermal deformation of the cooling drum 50 is small, the gap clearance between the cooling drums 50 and the side weirs 69 also becomes very small, and hence a casting fin of the cast piece also becomes small.

Figure 5:
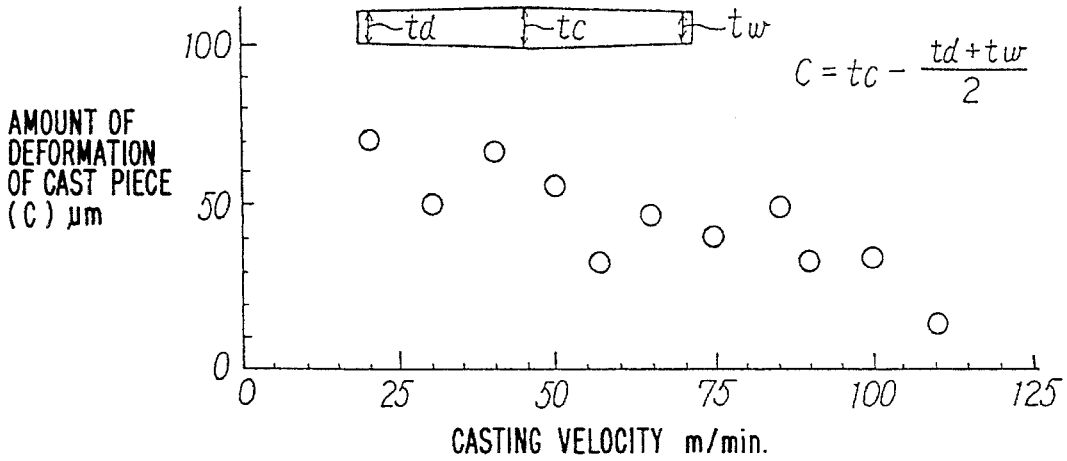
FIG. 5 is a diagram showing an amount of deformation of a band-shaped cast piece in the case where hourglass-shaped preset distortion is provided in a cooling drum.
Figure 6:
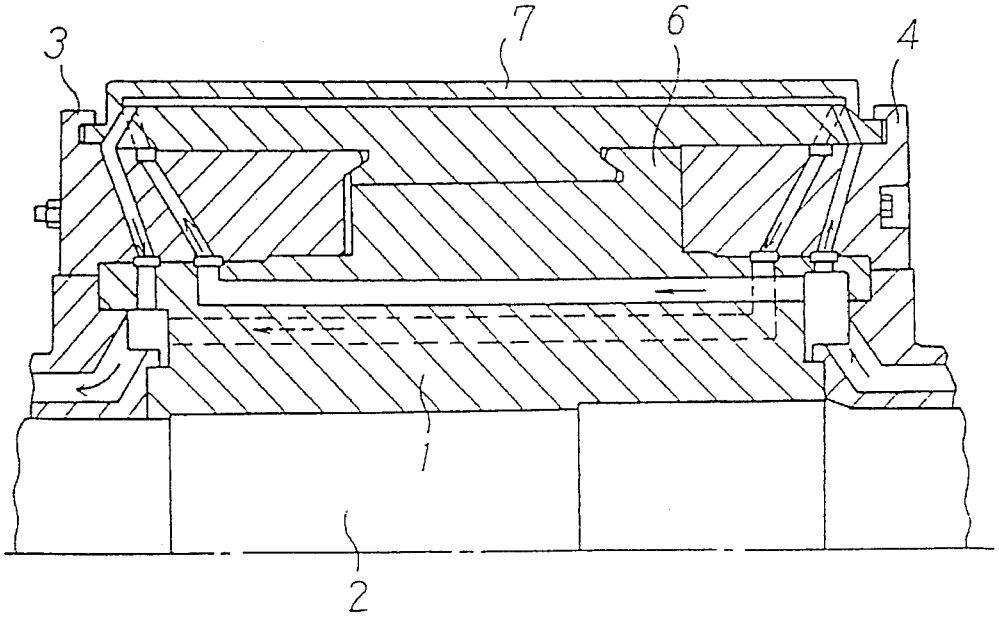
FIG. 6 (PRIOR ART)
FIG. 6 is a one-side cross-section view of one example of cooling drums in the prior art.

On the basis of the above-mentioned result, in the grinding of the outer circumferential surface after bonding of the cooling member 53 to the rigid member 51, the cooling member 53 was ground into an hourglass-shape (preset distortion). As a result of use of such cooling drum, the sheet configuration of the cast piece 71 became very favorable shape as indicated in FIG. 5.

SECOND PREFERRED EMBODIMENT

Next, as a second preferred embodiment of the present invention, a pair of cooling drums 50 were manufactures, each of which has an outer diameter of 1200 mm, a width of 604 mm, a thickness of a rigid member 51 of 250 mm, a thickness of a cooling member 53 of 48 mm and a thickness of a heat-resistance member 54 of 0.4 mm ($D_{Ri}/D_R \approx 0.55$) and whose other dimensions shapes and materials are identical to the first preferred embodiment, and they were used in twin-drum type continuous casting tests of austenite group stainless steel.

As a result, the barrel-shaped deformation of the outer circumferential surface of the cooling drum 50 was 300 μm in terms of a difference in radius as cast piece data, and distribution of deformation according to lapse of a casting time was also ±15 μm in terms of a standard deviation.

On the basis of this result, the outer circumferential surface of the cooling drum 50 was ground into a barrel-shape and then was put in use.

It is to be noted that while the cooling drum according to the present invention is used in a twin-drum type continuous casting system of austenite group stainless steel in the above-described first and second preferred embodiments, it is also possible to utilize this cooling drum in a single-drum type continuous casting, and further the same cooling drum is available in a continuous casting system of carbon steel, aluminium or copper-alloy.

As described in detail above, in the cooling drum for a continuous casting system according to the present invention, a three-layer structure is formed by metallurgically bonding a cylindrical rigid member to a cylindrical cooling member and plating a heat-resistance member on an outer circumferential surface through electro-deposition and cooling holes for the cooling member are provided in the axial direction within the cooling member as distributed along the circumferential direction of the drum over the entire circumference, and as a result, the following advantages are offered. At first, the heat-resistance member decreases transmission of sensible heat and heat of solidification of molten metal to the cooling member. The cooling member transmits the above-described transmitted heat to coolant flowing through the cooling holes in the cooling member to reduce its temperature rise. Furthermore, thermal deformation of the cooling member can be prevented by restraining the cooling member by means of the rigid member. Accordingly, a highly qualified band-shaped cast piece having little difference in thickness between the central portion in the widthwise direction and the opposite edge portions, can be continuously cast.

While a principle of the present invention has been described above in connection to preferred embodiments of the invention, it is intended that all matter contained in the above description and illustrated in the accompanying drawings shall be interpreted to be illustrative and not in a limiting sense.

What is claimed is:

1. A cooling drum for a continuous casting system in which molten metal is cooled and solidified by means of a rotating cooling drum or drums; comprising a three-layer structure consisting of a cylindrical rigid member, a cylindrical cooling member fitted around an outer circumferential surface of said rigid member and having its inner circumferential surface metallurgically bonded to said outer circumferential surface, and a heat-resistance member formed by electro-deposition, plating on an outer circumferential surface of said cooling member, and provided with cooling holes drilled in said cooling member as distributed over its entire circumference and extending in the axial direction of said cooling drum, and coolant passageways connecting the opposite axial end portions of said respective cooling holes with an inner circumferential surface of said rigid member.

2. A cooling drum for a continuous casting system as claimed in claim 1, wherein said rigid member is made of austenite group stainless steel, said cooling member is made of either Cu or Cu-alloy, and said heat-resistance member is made of either a mono-layer plated metal as of Ni, Ni-alloy, Co or Co-alloy or a multi-layer plated metal as of Ni-polynite-Cr.

3. A cooling drum for a continuous casting system as claimed in claim 1, wherein said rigid member is shaped in such manner that a ratio of its inner diameter to its outer diameter may take a value of 0.4–0.6.

4. A cooling drum for a continuous casting system as claimed in claim 1, wherein an interval in the circumferential direction of the drum between the centers of the adjacent cooling holes of said cooling member is chosen to be equal to or smaller than twice a distance between the center of the cooling hole and the outer circumferential surface of said cooling member.

* * * * *